US011419366B2

(12) United States Patent
Kassel

(10) Patent No.: US 11,419,366 B2
(45) Date of Patent: Aug. 23, 2022

(54) INFANT BODYSUIT OF MULTI-LAYER CONSTRUCTION

(71) Applicant: Lee-Anne Kassel, Maraisburg Roodepoort (ZA)

(72) Inventor: Lee-Anne Kassel, Maraisburg Roodepoort (ZA)

( * ) Notice: Subject to any disclaimer, the term of this patent is extended or adjusted under 35 U.S.C. 154(b) by 0 days.

(21) Appl. No.: 16/466,303

(22) PCT Filed: Dec. 5, 2017

(86) PCT No.: PCT/IB2017/057638

§ 371 (c)(1),
(2) Date: Jun. 4, 2019

(87) PCT Pub. No.: WO2018/104851

PCT Pub. Date: Jun. 14, 2018

(65) Prior Publication Data

US 2019/0343191 A1 Nov. 14, 2019

(30) Foreign Application Priority Data

Dec. 5, 2016 (ZA) ..... 2016/08359

(51) Int. Cl.

| | |
|---|---|
| ***A41B 13/08*** | (2006.01) |
| ***A41B 13/04*** | (2006.01) |
| *A41B 13/06* | (2006.01) |
| *A41D 11/00* | (2006.01) |

(52) U.S. Cl.

CPC ..... *A41B 13/08* (2013.01); *A41B 13/04* (2013.01); *A41B 13/06* (2013.01); *A41B 2400/44* (2013.01); *A41B 2400/62* (2013.01); *A41D 11/00* (2013.01)

(58) Field of Classification Search

CPC ..... A41B 13/08; A41B 13/04; A41B 13/06; A41B 2400/44; A41B 2400/62; A41D 11/00

See application file for complete search history.

(56) References Cited

U.S. PATENT DOCUMENTS

| | | | | |
|---|---|---|---|---|
| 2,469,556 | A * | 5/1949 | Jacobson | A41B 13/005 2/83 |
| 3,658,064 | A * | 4/1972 | Pociluyko | A61F 13/15211 604/360 |
| 5,819,317 | A * | 10/1998 | Conway | A61F 13/5605 2/111 |
| 2012/0260391 | A1* | 10/2012 | Davtyan | A41D 13/0537 2/22 |

* cited by examiner

*Primary Examiner* — Gloria M Hale

(57) ABSTRACT

The invention provides for an infant bodysuit (10) of multi-layer construction which includes a fabric layer (30) laminated to the inside of the infant bodysuit (10) which fabric layer (30) may consist of a substantially water proof membrane (32) which operatively serves to retain moisture on the inside thereof and allow transfer of moisture through the membrane and evaporation thereof on the outside of the membrane, characterised in that the membrane is an imperforate monolithic membrane that may be selected to provide a transfer mechanism for moisture which includes the steps of absorption of moisture on one side of the membrane where there may be higher humidity, diffusion through the membrane, and desorption of moisture on the other side of the membrane where there may be lower humidity.

10 Claims, 3 Drawing Sheets

INFANT BODYSUIT OF MULTI-LAYER CONSTRUCTION

FIELD OF THE INVENTION

This invention relates to a baby bodysuit and more particularly relates to a baby garment for babies which is aimed at restricting moisture from coming into contact with the baby's skin and bedding on which the baby sleeps, hence keeping the baby dry and comfortable.

BACKGROUND TO THE INVENTION

An infant bodysuit is a garment designed to be worn by infants much like a T-shirt. However they are distinguishable from T-shirts by an extension below the waist, with snaps or a hook and loop fastener that allow it to be closed over the crotch area.

The purpose of the opening at the crotch is to facilitate access to the infant's diaper during the changing period.

Infant bodysuits come in a wide variety of designs and may be worn as undergarments or as outer shirts.

The infant bodysuit ranges may include various types of garments for wear during winter as well as summer. For example, a typical design during winter will result in an infant bodysuit to include long sleeves and leg portions, whilst during summer short sleeves and legs portions form a typical design.

Recently the market has seen designs in which the leg portion of the infant bodysuit is constructed to terminate in a sleeping bag formation, whilst the sleeves are still present.

It will be appreciated that many different designs are currently available for parents to choose from.

In general terms the infant bodysuit may also be termed a "babygrow". The use of the term babygrow in this specification specifically relates to the typical infant bodysuit hereinbefore described.

The main objective of a babygrow is to provide a garment in which an infant may comfortably rest. As stated hereinbefore it may be worn as an undergarment, alternatively as an outer garment. The infant generally would have a diaper wrapped around the buttocks to retain excreted body fluids such as urine.

It is of vital importance that infants are allowed sufficient time to rest during which rest they normally sleep. This is especially important during the early stages of development as both mother and infant is still recovering from the birth. In the event that the infant continuously wakeup, the parents may become agitated and in severe circumstance this may result in depression.

Mothers, who generally breast feed, are required to feed their infants at intervals of between 2-4 hours. It will be appreciated that as the intervals are so short, it is very important that both infant and mother gain as much sleep as possible during the non-feeding intervals.

Infants may have between 6-8 wet diapers during early stages of growth. However, although diapers have been designed to retain most body fluids excreted, it often occurs that the diapers either shift or do not properly align with the body of the infant, resulting in the diaper leaking.

During leaking, both the bedding and the infant become wet, resulting in a very uncomfortable environment for the infant to sleep in and does the infant generally wake up. This can become very frustrating for parents as not only does the infant need to be changed, but also the bedding before the infant may be laid down again.

It may also occur that an infant may vomit, again resulting in the infant being uncomfortable and waking up.

OBJECT OF THE INVENTION

It is an object of the current invention to provide an infant bodysuit which will at least partially alleviate some of the aforementioned problems and keep the skin of an infant at least partially dry during the excretion of body fluids such as urine or vomit, to ensure a comfortable and dry environment for the infant to sleep in.

SUMMARY OF THE INVENTION

The invention provides for an infant bodysuit of multilayer construction which includes a fabric layer laminated to the inside of the infant bodysuit which fabric layer may consist of a substantially water proof membrane which operatively serves to retain moisture on the inside thereof and allow transfer of moisture through the membrane and evaporation thereof on the outside of the membrane, characterised in that the membrane is an imperforate monolithic membrane that may be selected to provide a transfer mechanism for moisture which includes the steps of absorption of moisture on one side of the membrane where there may be higher humidity, diffusion through the membrane, and desorption of moisture on the other side of the membrane where there may be lower humidity.

The infant bodysuit may further include an inner moisture collecting layer on the inside of the monolithic membrane and a moisture dissipating layer on the outside of the monolithic membrane wherein the inner moisture collecting layer may be laminated to the inner side of the monolithic membrane and the moisture laminate dissipating layer may be laminated to the opposing outside of the monolithic membrane. It will be appreciated that the multiple layers may be loose or alternatively laminated.

In a preferred embodiment of the invention, the multilayer construction may include an outer aesthetically appealing layer which may be optionally laminated to the moisture dissipating layer provided on the outer side of the monolithic membrane and a hydrophobic innermost liner layer which may be in direct contact with infant skin.

The hydrophobic innermost liner may be a polymeric material such as polyester, poly-cotton or any combination of the aforementioned.

The monolithic membrane may be between 7-20 microns thick and in a preferred embodiment of the invention may be approximately 10 microns in thickness.

The innermost liner layer made of a woven or nonwoven fabric and may be inherently hydrophobic so as to operatively serve as a transfer layer between an infant skin and the inside of the infant bodysuit whilst it remaining substantially dry.

The infant bodysuit may yet further include a pocket, which pocket may be capable to receive and accommodate an interchangeable fabric multilayer as hereinbefore described.

In a preferred embodiment of the invention, the pocket may extend along the buttocks of an infant and terminate in the crouch area.

The pocket may be closable with suitable fasteners such as clips, a zip or alternatively a hook and loop fastener, VELCRO It will further be appreciated by those skilled in the art that the above described invention will at least partially alleviate some of the aforementioned problems.

BRIEF DESCRIPTION OF THE DRAWINGS

The invention is now further described by way of example with reference to the accompanying drawings wherein.

DESCRIPTION OF PREFERRED EMBODIMENTS

In the following embodiments individual characteristics, given in connection with specific embodiments, may actually be interchanged with other different characteristics that exist in other embodiments.

Figure 1:
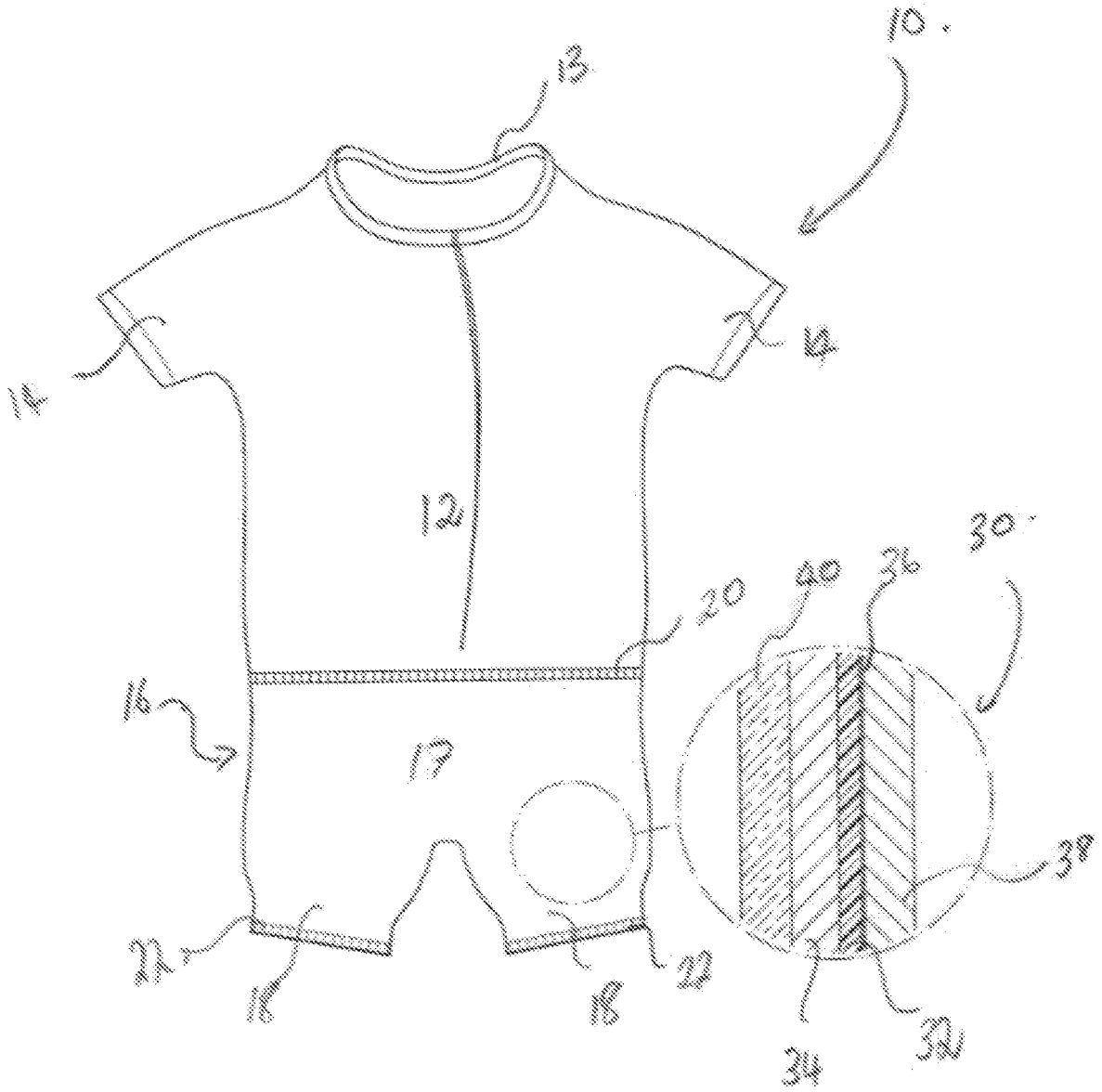
FIG. 1 is a front elevation of a short sleeve infant bodysuit according to the invention.

FIG. 1 illustrates an infant body suit (10) having a body part (12), defining a collar (13) through which an infant neck extends, a pair of short sleeves (14) extending from the body part (12), a crotch area (16) extending from the lower end of the body part (12), the crotch area (16) terminating in a pair of legs (18) to define a short.

In a preferred embodiment of the invention, the crotch area (16) includes an elastic band (20) extending along the waist line of an infant, and an elastic band (22) extending around each leg portion (18) to define a containment area (17).

In general the containment area is lined with multi-layer construction which includes a fabric layer (30) laminated to the inside of the infant bodysuit (10) which fabric layer consists of a substantially water proof membrane (32) which operatively serves to retain liquid on the inside thereof and allow transfer of moisture through the membrane (32) and evaporation thereof on the outside of the membrane, characterised in that the membrane is an imperforate monolithic membrane to provide a transfer mechanism for moisture which includes the steps of absorption of moisture on one side of the membrane where there may be higher humidity, diffusion through the membrane, and desorption of moisture on the other side of the membrane where there may be lower humidity.

The infant bodysuit (10) may further include an inner moisture collecting layer (34) on the inside of the monolithic membrane (32) and a moisture dissipating layer (36) on the outside of the monolithic membrane wherein the inner moisture collecting layer 34) is laminated to the inner side of the monolithic membrane (32) and the moisture laminate dissipating layer (36) is laminated to the opposing outside of the monolithic membrane (32). It will be appreciated that the multiple layers may be loose or alternatively laminated.

In a preferred embodiment of the invention, the multi-layer construction (30) may include an outer aesthetically appealing layer (38) which is optionally laminated to the moisture dissipating layer (36) provided on the outer side of the monolithic membrane (32) and a hydrophobic innermost liner layer (40) which may be in direct contact with infant skin.

The hydrophobic innermost liner (40) in general consist of a polymeric material such as polyester, poly-cotton or any combination of the aforementioned.

The monolithic membrane (32) is between 7-20 microns thick and in a preferred embodiment of the invention is approximately 10 microns in thickness.

The innermost liner layer (40) may be made of a woven or nonwoven fabric and is inherently hydrophobic so as to operatively serve as a transfer layer between an infant skin (not shown) and the inside of the infant bodysuit whilst it remaining substantially dry.

Figure 2:
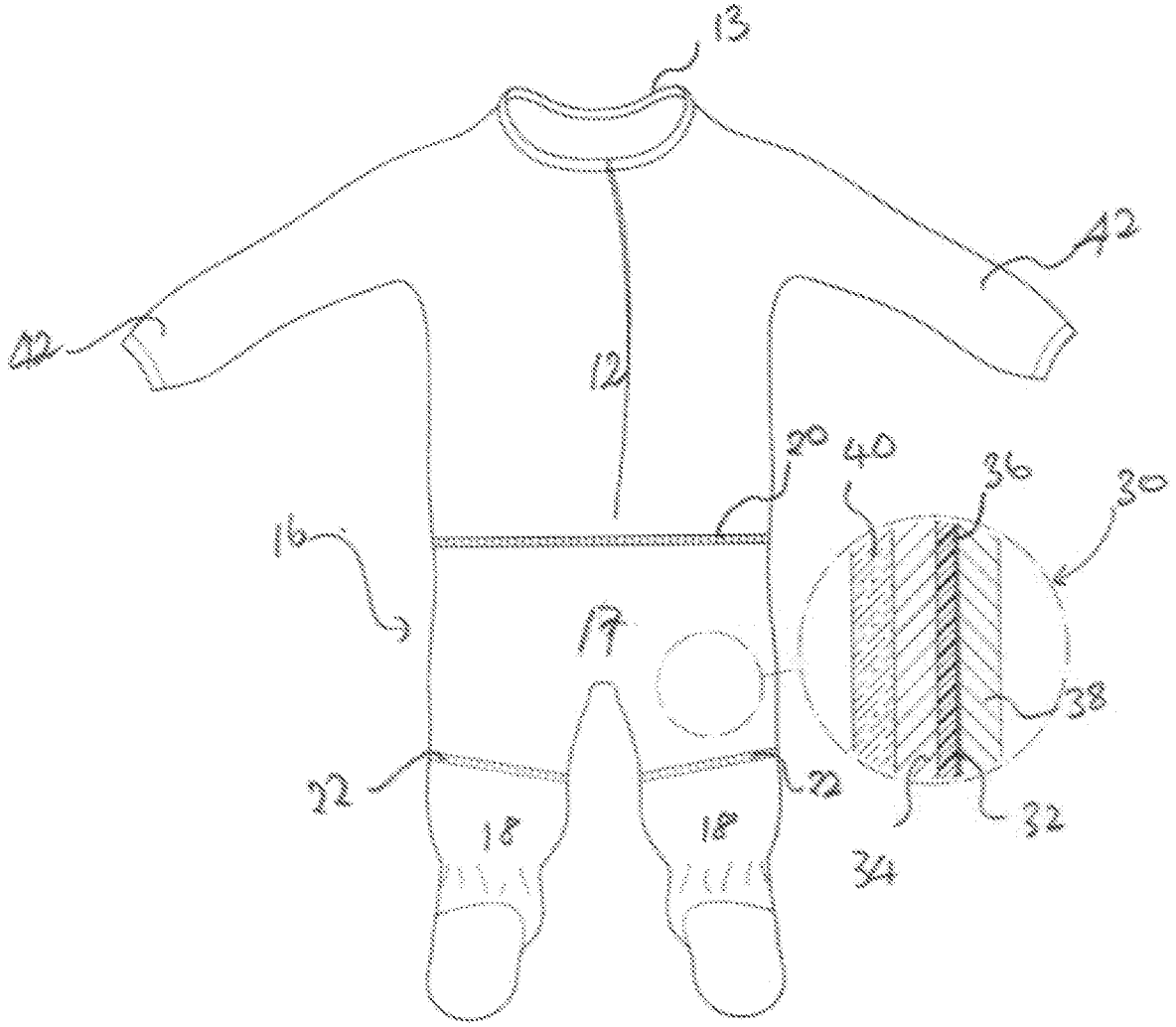
FIG. 2 is a front elevation of a long sleeve infant bodysuit according to the invention.
Figure 3:
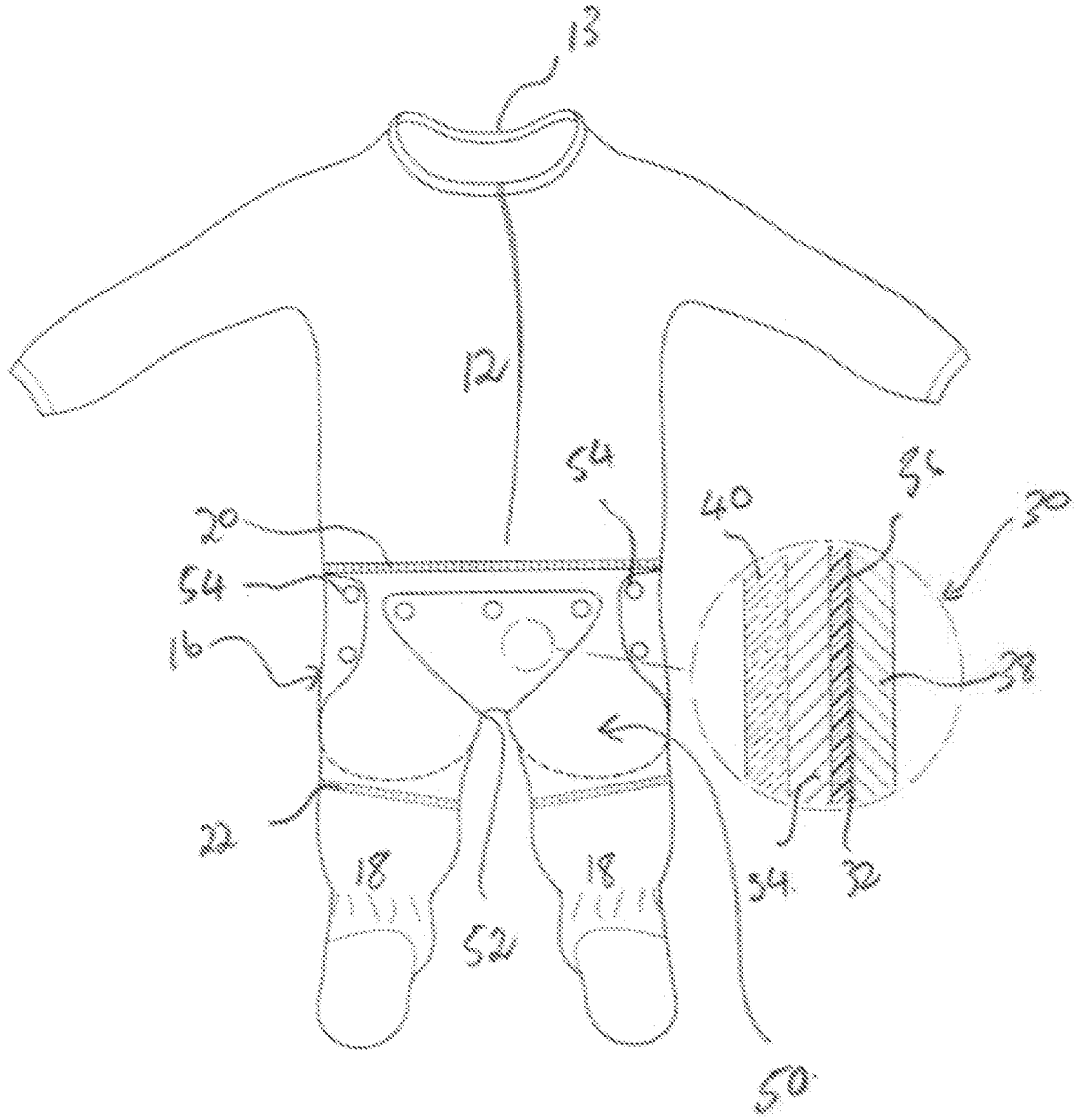
FIG. 3 is a front elevation of an infant body suit having a pocket which is capable to accommodate and receive an interchangeable multi fabric layer according to the invention.

FIG. 2 illustrates an elevated front view of a similar body suit described in FIG. 1, having a body part (12), defining a collar (13) through which an infant neck extends, a pair of long sleeves (42) extending from the body part (12), a crotch area (16) extending from the lower end of the body part (12), the crotch area (16) terminating in a pair of legs (18) to define a trouser.

In this configuration of the invention, the crotch area (16) also includes an elastic band (20) extending along the waist line of an infant, and an elastic band (22) extending around each leg portion (18) to define a containment area (17).

Again, in general the containment area (17) is lined with multi-layer construction which includes a fabric layer (30) laminated to the inside of the infant bodysuit (10) which fabric layer consist of a substantially water proof membrane (32) which operatively serves to retain liquid on the inside thereof and allow transfer of moisture through the membrane (32) and evaporation thereof on the outside of the membrane, characterised in that the membrane is an imperforate monolithic membrane to provide a transfer mechanism for moisture which includes the steps of absorption of moisture on one side of the membrane where there may be higher humidity, diffusion through the membrane, and desorption of moisture on the other side of the membrane where there may be lower humidity.

The infant bodysuit (10) may further include an inner moisture collecting layer (34) on the inside of the monolithic membrane (32) and a moisture dissipating layer (36) on the outside of the monolithic membrane wherein the inner moisture collecting layer 34) is laminated to the inner side of the monolithic membrane (32) and the moisture laminate dissipating layer (36) is laminated to the opposing outside of the monolithic membrane (32). It will be appreciated that the multiple layers may be loose or alternatively laminated.

In a preferred embodiment of the invention, the multi-layer construction (30) may include an outer aesthetically appealing layer (38) which is optionally laminated to the moisture dissipating layer (36) provided on the outer side of the monolithic membrane (32) and a hydrophobic innermost liner layer (40) which may be in direct contact with infant skin.

The hydrophobic innermost liner (40) in general consist of a polymeric material such as polyester, poly-cotton or any combination of the aforementioned.

The monolithic membrane (32) is between 7-20 microns thick and in a preferred embodiment of the invention is approximately 10 microns in thickness.

The innermost liner layer (40) may be made of a woven or nonwoven fabric and is inherently hydrophobic so as to operatively serve as a transfer layer between an infant skin (not shown) and the inside of the infant bodysuit whilst it remaining substantially dry.

In a third embodiment of the invention, the infant bodysuit (10) includes a pocket area (50), which pocket area (5) is capable to receive and accommodate an interchangeable fabric multilayer as hereinbefore described.

The pocket area (50) generally extend along the buttocks of an infant and terminate in the crouch area (52).

The pocket area (50) is closable with suitable fasteners (54) such as clips, a zip, alternatively VELCRO, hook and loop fastener.

It will be appreciated by those skilled in the art that the pocket area (50) allows a user to insert an additional multi-layer construction and furthermore it may be insert from the inner side of the infant bodysuit, alternatively the outer side of the infant bodysuit.

In one embodiment of the invention, the monolithic membrane consists of co-polyesters and thermoplastic elastomers. Typically the thickness of the membrane may vary between 7-20 microns. However, in a preferred embodiment of the invention, the thickens of the monolithic member is approximately 10 microns.

The inner most collecting layers in general consist of polyester, alternatively polycotton or any combination of the aforementioned. This layers serves to collect moisture and hold it in contact with the monolithic membrane so that transfer of the moisture through the membrane can take place according to the mechanism described hereinbefore.

The hydrophobic innermost liner (40) preferably consist of polyester and is typically an eyelet type of fabric. The purpose served by this layer is to "wick" moisture away from the skin and leave it rather dry, a most desirable property to ensure undisturbed sleep of an infant when wet. The innermost liner (40) being inherently hydrophobic thus operatively serves as transfer layer between the infant's skin whilst remaining substantially dry.

It will be appreciated that each relevant layer may be laminated or alternatively may be loose.

The laminated structure finally includes an outer aesthetically appealing layer (38) which layer may include depictions or wording thereon.

It will be appreciated by those skilled in the art that the elastic bands (20) and (22) respectively serves to define the containment area (17). However, the entire bodysuit may be lined or alternatively manufacture from the multi-layer construction fabric as hereinbefore described.

Yet further, the pocket area serves to allow a user to replace the multi-layer construction, alternatively to add an additional layer to allow for even better absorption and comfort for an infant during sleep.

It will be appreciated that the hereinbefore described invention will at least partially alleviate some of the aforementioned problems.

The invention claimed is:

1. An infant bodysuit for encasing an infant and for moisture management of said infant therein, comprising:

an outer body part formed of a fabric material configured to cover a torso of an infant, a collar through which said infant neck extends at a top end of the body part; a pair of sleeves extending from the body part to cover said infants arms, an elastic waistband, a crotch part extending from a lower end of the body part and terminating in a pair of legs wherein the body part, sleeves and legs define an infant body containment area; said infant body containment area includes a multi-layer fabric construction including an inner fabric layer laminated to an inside of the infant body suit fabric material; said fabric layer consists of a waterproof imperforate monolithic membrane; said monolithic membrane functions to retain liquid on an inside of the infant body suit fabric while also allowing a transfer of moisture through the membrane and evaporation of said moisture on an outside of the membrane; said imperforate monolithic membrane is configured to provide a transfer of moisture on an inside of said membrane of higher humidity and diffusion through said membrane to another side of said membrane that has a lower humidity.

2. An infant body suit as claimed in claim 1 and further wherein said multilayer fabric construction further includes an inner moisture collecting layer laminated on an inside of the monolithic membrane and a moisture dissipating layer is laminated on an outside of the monolithic membrane.

3. An infant bodysuit as claimed in claim 1 wherein said outer body part fabric is aesthetically appealing and is laminated to the moisture dissipating layer on the outer side of the monolithic membrane and a hydrophobic inner most liner layer that is configured to be in direct contact with a skin surface of said infant.

4. An infant bodysuit as claimed in claim 3 and further wherein the hydrophobic inner most liner layer is a polymeric material including any one of polyester, poly cotton or any combination there of.

5. An infant bodysuit as claimed in claim 1 and further wherein said monolithic membrane has a thickness of 7-10 microns.

6. An infant bodysuit as claimed in claim 1 and further wherein said monolithic membrane has a thickness of 10 microns.

7. An infant bodysuit as claimed in claim 1 wherein the inner fabric layer is constructed of a woven or non woven fabric that is hydrophobic and is configured to transfer moisture therethrough from contact with an infant skin surface and an inside of the infant bodysuit to ensure that said infant wearer is substantially dry.

8. An infant bodysuit as claimed in claim 1 wherein said infant bodysuit further includes a pocket that is capable to receive and accommodate an interchangeable multilayer fabric panel.

9. An infant bodysuit as claimed in claim 8 and further wherein said pocket extends along a buttocks of said infant and terminates in a crotch area.

10. An infant bodysuit as claimed in claim 8 and further wherein said pocket is closeable and includes fasteners of any of clips, a zipper or a hook and loop fastener.

* * * * *